US007773051B2

(12) United States Patent
Kobayashi

(10) Patent No.: US 7,773,051 B2
(45) Date of Patent: Aug. 10, 2010

(54) DISPLAY APPARATUS DRIVING CIRCUITRY

(75) Inventor: Hideto Kobayashi, Tokyo (JP)

(73) Assignee: Fuji Electric Systems Co., Ltd., Tokyo (JP)

( * ) Notice: Subject to any disclaimer, the term of this patent is extended or adjusted under 35 U.S.C. 154(b) by 1174 days.

(21) Appl. No.: 10/892,479

(22) Filed: Jul. 16, 2004

(65) Prior Publication Data

US 2005/0035960 A1 Feb. 17, 2005

(30) Foreign Application Priority Data

Jul. 30, 2003 (JP) ..... PA 2003-282234
Nov. 20, 2003 (JP) ..... PA 2003-390062

(51) Int. Cl.
*G09G 3/28* (2006.01)

(52) U.S. Cl. ..... 345/63; 345/60; 315/169.4

(58) Field of Classification Search ..... 345/211, 345/212, 60–72; 315/169.1–194.4
See application file for complete search history.

(56) References Cited

U.S. PATENT DOCUMENTS 6,348,831 B1 * 2/2002 Baba ..... 327/537

FOREIGN PATENT DOCUMENTS

| | | | |
|---|---|---|---|
| JP | 3-187614 | A | 8/1991 |
| JP | 5-235737 | A | 9/1993 |
| JP | 7-321621 | A | 12/1995 |
| JP | 11-098000 | | 4/1999 |
| JP | 2001-134230 | | 5/2001 |
| JP | 2002-176168 | | 6/2002 |
| JP | 2003-101391 | A | 4/2003 |

* cited by examiner

*Primary Examiner*—Sumati Lefkowitz
*Assistant Examiner*—Seokyun Moon
(74) *Attorney, Agent, or Firm*—Rabin & Berdo, P.C.

(57) ABSTRACT

A display apparatus driving circuitry for driving a plasma display panel. A first transistor is electrically connected between an output terminal and a high-voltage power supply terminal. A second transistor is connected between the output terminal and a reference power supply terminal. A buffer circuit supplies a voltage lower than a low voltage VDL for logic to a gate of the second transistor to make a drop in an output waveform gradual during an address electrical discharge. In a preferred embodiment, during this drop in the output waveform, a p-channel type MOSFET of the buffer circuit is turned on, whereby the VDL is suppressed due to a back gate effect. Therefore, a signal at a potential lower than the VDL is inputted to the gate of the second transistor. As a result, the drop in the second transistor output waveform is gradual, so that noise and damage are prevented.

6 Claims, 9 Drawing Sheets

DISPLAY APPARATUS DRIVING CIRCUITRY

BACKGROUND OF THE INVENTION

1. Field of the Invention

The invention relates to display apparatus driving circuitry, and in particular relates to display apparatus driving circuitry for driving a plasma display panel.

2. Prior Art

In recent years, plasma display panels (hereinafter referred to as 'PDPs'), which can be made large in size and can be made thin and light-weight, have come into the limelight as display apparatuses in television broadcast receivers, personal computers and so on. FIG. 9 shows schematically an example of the constitution of a PDP driving apparatus for driving a PDP.

For the sake of simplicity, the case of a two-electrode PDP 100 is shown in FIG. 9. The driving apparatus for the PDP 100 is constituted from a plurality of scan driver ICs (Integrated Circuits) 101-1, 101-2, 101-3, . . . , **101-*n* and data (address) driver ICs 102-1, 102-2, 102-3, . . . , 102-*m*** and so on (here, n and m are arbitrary integers).

The scan driver ICs 101-1 to **101-*n* each drive a plurality of scanning/sustaining electrodes 111, and the data (address) driver ICs 102-1 to 102-*m* each drive a plurality of data electrodes 112 corresponding to the colors red, green and blue. These scanning/sustaining electrodes 111 and data electrodes 112** are arranged in a grid so as to be perpendicular to one another, and electrical discharge cells (not shown) are disposed at the points of intersection therebetween.

If, for example, each of the scan driver ICs 101-1 to **101-*n* can drive 64 scanning/sustaining electrodes 111, then in the case that the pixels of the PDP 100 form an XGA (extended video Graphics Array), the number of pixels will be 1024×768, and hence the number of scan driver ICs 101-1 to 101-*n*** will be 12.

When displaying an image, using the scan driver ICs 101-1 to **101-*n* and data (address) driver ICs 102-1 to 102-*m*, data from the data electrodes 112 is written into the electrical discharge cells while scanning through the scanning/sustaining electrodes 111 one at a time, and electrical discharge sustaining pulses are outputted to the scanning/sustaining electrodes 111** to sustain the electrical discharges for an electrical discharge sustaining period, whereby display of the image is carried out.

Here, for the case of a conventional scan driver IC (hereinafter referred to as 'display apparatus driving circuitry'), a description will be given of the output stage circuitry for the part driving one scan line, with reference to FIG. 10. FIG. 10 is a circuit diagram of the output stage in conventional PDP display apparatus driving circuitry. The circuitry of FIG. 10 has a level shifter circuit 121, a buffer circuit 130, and two IGBTs (Insulated Gate Bipolar Transistors) 122 and 123, which are devices through which a large current can be passed per unit area.

The level shifter circuit 121 is constituted from a high-voltage-resistant PMOS or NMOS, not shown. Moreover, an input terminal 141 into which a signal (0 to 5 volts) is inputted from a control circuit, not shown, is connected to the level shifter circuit 121. The level shifter circuit 121 converts this signal into a signal of 0 to 100 volts, and inputs the converted signal into the gate of the IGBT 122.

The buffer circuit 130 is connected to an input terminal 142. A 0 to 5 volt signal is inputted to the input terminal 142 from a control circuit, not shown. The output from the buffer circuit 130 is outputted into the gate of the IGBT 123.

The conventional buffer circuit 130 is constituted from a CMOS (Complementary MOS). It includes a p-channel type MOSFET (Metal Oxide Semiconductor Field Effect Transistor (hereinafter merely referred to as a 'PMOS') 131 and an n-channel type MOSFET (hereinafter merely referred to as an 'NMOS') 132. The gates of the PMOS 131 and the NMOS 132 are both connected to the input terminal 142. The source of the PMOS 131 is connected to a low-voltage power supply terminal VDL. A low voltage of 0 to 5 volts for logic is supplied from the low-voltage power supply terminal VDL. The drain of the PMOS 131 is connected to the gate of the IGBT 123 and the drain of the NMOS 132. The source of the NMOS 132 is connected (grounded) to a reference power supply terminal GND (hereinafter merely referred to as 'GND').

The collector terminal of the IGBT 122 is connected to a high-voltage power supply terminal VDH from which a high voltage of 0 to 100 volts is supplied. The emitter of the IGBT 122 is connected to an output terminal OUT and the collector of the IGBT 123. Moreover, the emitter of the IGBT 123 is connected to GND.

The output terminal OUT is connected to a scanning/sustaining electrode 111 as shown in FIG. 9. It is further connected to an electrical discharge cell (which can be regarded as a capacitor C).

Note that in the following, a voltage of 100 volts supplied from the high-voltage power supply terminal VDH is sometimes referred to merely as 'VDH', and a voltage of 5 volts supplied from the low-voltage power supply terminal VDL is sometimes referred to merely as 'VDL'.

With such circuitry, for example, when a signal of 0 to 5 volts is inputted to the input terminal 141, and hence the input terminal 141 becomes 'H', this signal is converted into a signal of 0 to 100 volts by the level shifter circuit 121, and hence the gate of the IGBT 122 is made to be 'H', and thus the IGBT 122 is turned on, and hence a signal with a high voltage of 100 volts is outputted to the output terminal OUT.

At the time of an address electrical discharge (writing using a data electrode 112 as described earlier), it is necessary to turn the IGBT 123 on, and thus reduce the potential at the output terminal OUT to 0 volts. To do this, the input terminal 141 is made to be 'L', and the signal of 0 to 5 volts at the input terminal 142 is made to be 'L', whereby, through the CMOS buffer circuit 130, the gate of the IGBT 123 is made to be 'H' (VDL) and hence the IGBT 123 is turned on. As a result 0 volts, i.e. the same potential as at the reference power supply terminal GND, is outputted to the output terminal OUT.

Here, part of the voltage and current waveforms during an address electrical discharge are shown for the output stage circuitry of the conventional display apparatus driving circuitry for driving a PDP shown in FIG. 10.

FIG. 11 is a timing diagram showing part of the voltage and current waveforms during an address electrical discharge for the output stage circuitry of the conventional display apparatus driving circuitry for driving a PDP.

Here, the relationship between the potential Vo at the output terminal OUT and the current Ic flowing into the collector of the IGBT 123 will be shown.

At time t1, the IGBT 123 is turned on, whereupon the potential Vo starts to drop to 0 V; at this time, a current $I_P$ flows into the GND connected to the emitter of the IGBT 123 due to charge stored in the electrical discharge cell connected to the output terminal OUT. When the potential Vo reaches 0 at time t2, the current $I_P$ stops flowing, and then once the effective voltage due to a high voltage applied to the data electrode 112 (see FIG. 9) has become sufficiently high (time t3), a plasma discharge is started, and hence a discharge current $I_H$ flows. The discharge current $I_H$ stops flowing at a time t4.

As the output stage circuitry in such display apparatus driving circuitry for driving a PDP, there is also circuitry in which, for example, the number of components in the circuitry is reduced by using a horizontal thyristor of an insulated gate type having no channel formed therein (see, for example, Japanese Patent Application Laid-open No. 2002-176168 (paragraphs nos. 0021 to 0026 and FIG. 3)

However, with conventional display apparatus driving circuitry, in the case in particular that devices having a large current driving capacity such as IGBTs are used so that a large current can be passed during an address electrical discharge, there has been a problem that the driving capacity is too great. This causes the waveform of the output potential to drop sharply (between times t1 to t2 in FIG. 11), and thus noise is prone to occur.

Moreover, there has been a problem that an excessive current tends to flow upon short-circuiting of the output terminal. This makes the circuit prone to damage.

OBJECT AND SUMMARY OF THE INVENTION

In view of such problems, it is an object of the invention to provide display apparatus driving circuitry according to which the drop in the output waveform during an address electrical discharge can be made gradual. By satisfying this objective, noise can be prevented, and breakage of the device due to an excessive current upon short-circuiting of the output can be prevented.

According to the invention, to attain the above object, there is provided display apparatus driving circuitry. The display apparatus driving circuitry has a first transistor that is electrically connected between an output terminal and a high-voltage power supply terminal from which a high voltage is supplied. A second transistor is connected between the output terminal and a reference power supply terminal. Also included is a buffer circuit having a first n-channel type MOS field effect transistor (hereafter NMOS) electrically connected between a gate of the second transistor and a low-voltage power supply terminal from which a low voltage for logic is supplied. The buffer circuit additionally includes a second n-channel type MOS field effect transistor (NMOS) that is electrically connected between the gate of the second transistor and the reference power supply terminal.

According to the above circuit construction, when a high voltage is applied, the first transistor is turned on, whereby a high voltage from the high-voltage power supply terminal is supplied to the output terminal. At the time of an address electrical discharge, the first n-channel type MOS field effect transistor (NMOS) of the buffer circuit is turned on. This causes suppression of the low voltage from the low-voltage power supply terminal due to a back gate effect. Therefore, a signal at a potential lower than this low voltage is inputted to the gate of the second transistor. As a result, the drop in the output waveform of the second transistor becomes gradual, thereby to prevent the production of noise.

Moreover, there is provided display apparatus driving circuitry, which includes a first transistor electrically connected between an output terminal and a high-voltage power supply terminal from which a high voltage is supplied. A second transistor is connected between the output terminal and a reference power supply terminal. Also included is a buffer circuit having a first p-channel type MOS field effect transistor (PMOS) electrically connected to a first low-voltage power supply terminal from which a first low voltage for logic is supplied. The buffer circuit also has a second p-channel type MOS field effect transistor (PMOS) that is electrically connected to a second low-voltage power supply terminal from which a second low voltage is supplied. Further provided in the buffer circuit are first and second n-channel type MOS field effect transistors. The n-channel type MOS field effect transistor is electrically connected between (a) a drain of the first p-channel type MOS field effect transistor and a drain of the second p-channel type MOS field effect transistor and (b) a gate of the second transistor. The second n-channel type MOS field effect transistor is electrically connected between the gate of the second transistor and the reference power supply terminal.

According to the above circuit arrangement, when a high voltage is applied, the first transistor is turned on, whereby a high voltage from the high-voltage power supply terminal is supplied to the output terminal. At the time of an address electrical discharge, the first n-channel type MOS field effect transistor of the buffer circuit is turned on, and either the first p-channel type MOS field effect transistor or the second p-channel type MOS field effect transistor is turned on. As a result, either the first low voltage or the second low voltage is selected, and is inputted to the gate of the second transistor after having been suppressed due to a back gate effect.

The invention has been made such that a transistor connected between an output terminal and a reference power supply terminal in display apparatus driving circuitry for a PDP is turned on at a voltage lower than a low voltage for logic. As a result, the drop in the output waveform during an address electrical discharge can be made gradual, and hence noise can be prevented. Moreover, the current supply capacity is suppressed, and hence breakage of the device due to an excessive current upon short-circuiting of the output can be prevented.

DETAILED DESCRIPTION OF THE PREFERRED EMBODIMENTS

Following is a detailed description of embodiments of the invention, with reference to the drawings.

Figure 1:
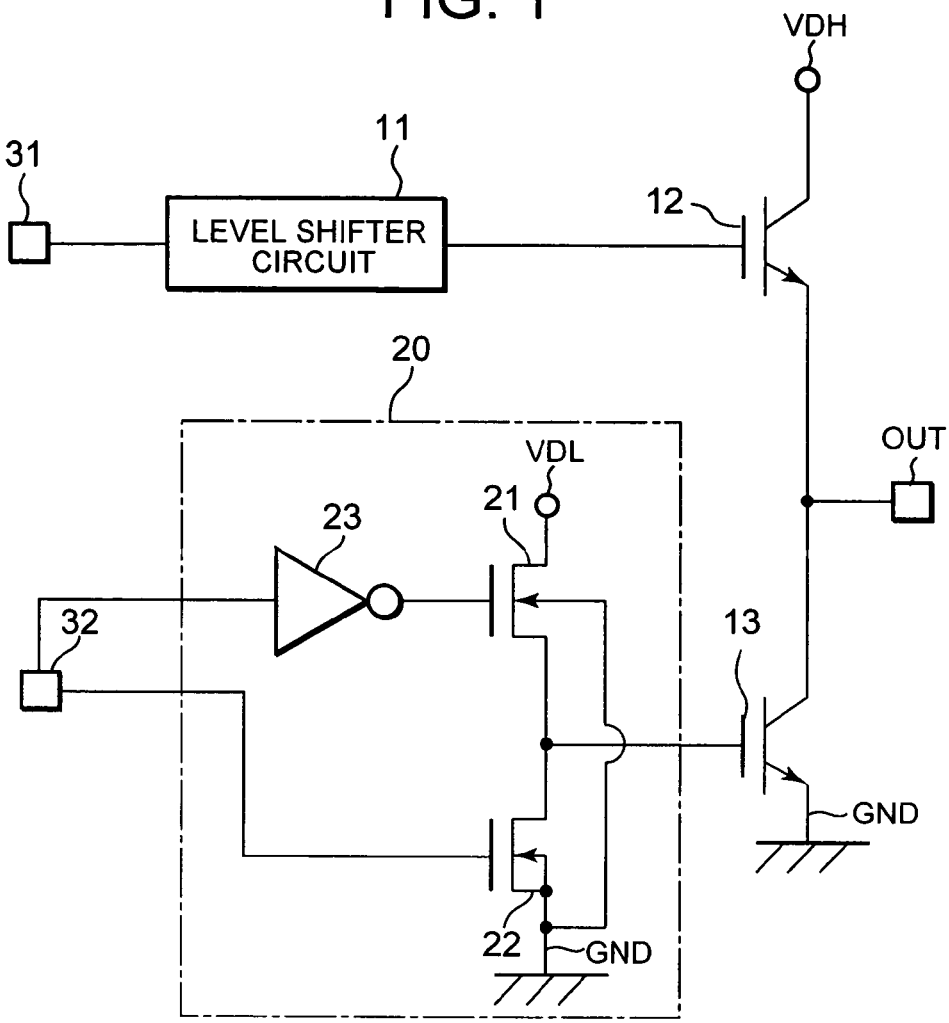
FIG. 1 is a circuit diagram of display apparatus driving circuitry of a first embodiment of the invention.

FIG. 1 is a circuit diagram of display apparatus driving circuitry of a first embodiment of the invention. The display apparatus driving circuitry has a level shifter circuit 11, a buffer circuit 20, and two IGBTs 12 and 13.

The level shifter circuit 11 is constituted from a high-voltage-resistant PMOS or NMOS, not shown. Moreover, an input terminal 31 into which a signal (0 to 5 volts) is inputted from a control circuit, not shown, is connected to the level shifter circuit 11. The level shifter circuit 11 converts this signal into a signal of 0 to 100 volts, and inputs the converted signal into the gate of the IGBT 12.

The buffer circuit 20 is connected to an input terminal 32 into which a signal (0 to 5 volts) is inputted from a control circuit, not shown, and the output from the buffer circuit 20 is supplied to the gate of the IGBT 13.

The buffer circuit 20 in the display apparatus driving circuitry of the first embodiment is constituted from two NMOSs 21 and 22, and an inverter circuit 23. The input terminal 32 is connected to the gate of the NMOS 22, and is connected to the gate of the NMOS 21 via the inverter circuit 23. The NMOS 21 is electrically connected between the gate of the IGBT 13 and a low-voltage power supply terminal VDL from which a low voltage of 0 to 5 volts for logic is supplied. Moreover, the source of the NMOS 21 is further connected to the drain of the NMOS 22. The NMOS 22 is electrically connected (grounded) between the gate of the IGBT 13 and a reference power supply terminal GND.

The IGBT 12 is electrically connected between an output terminal OUT and a high-voltage power supply terminal VDH from which a high voltage of 0 to 100 volts is supplied. Moreover, the emitter of the IGBT 12 is further electrically connected to the collector of the IGBT 13. The IGBT 13 is electrically connected (grounded) between the output terminal OUT and the reference power supply terminal GND.

Figure 9:
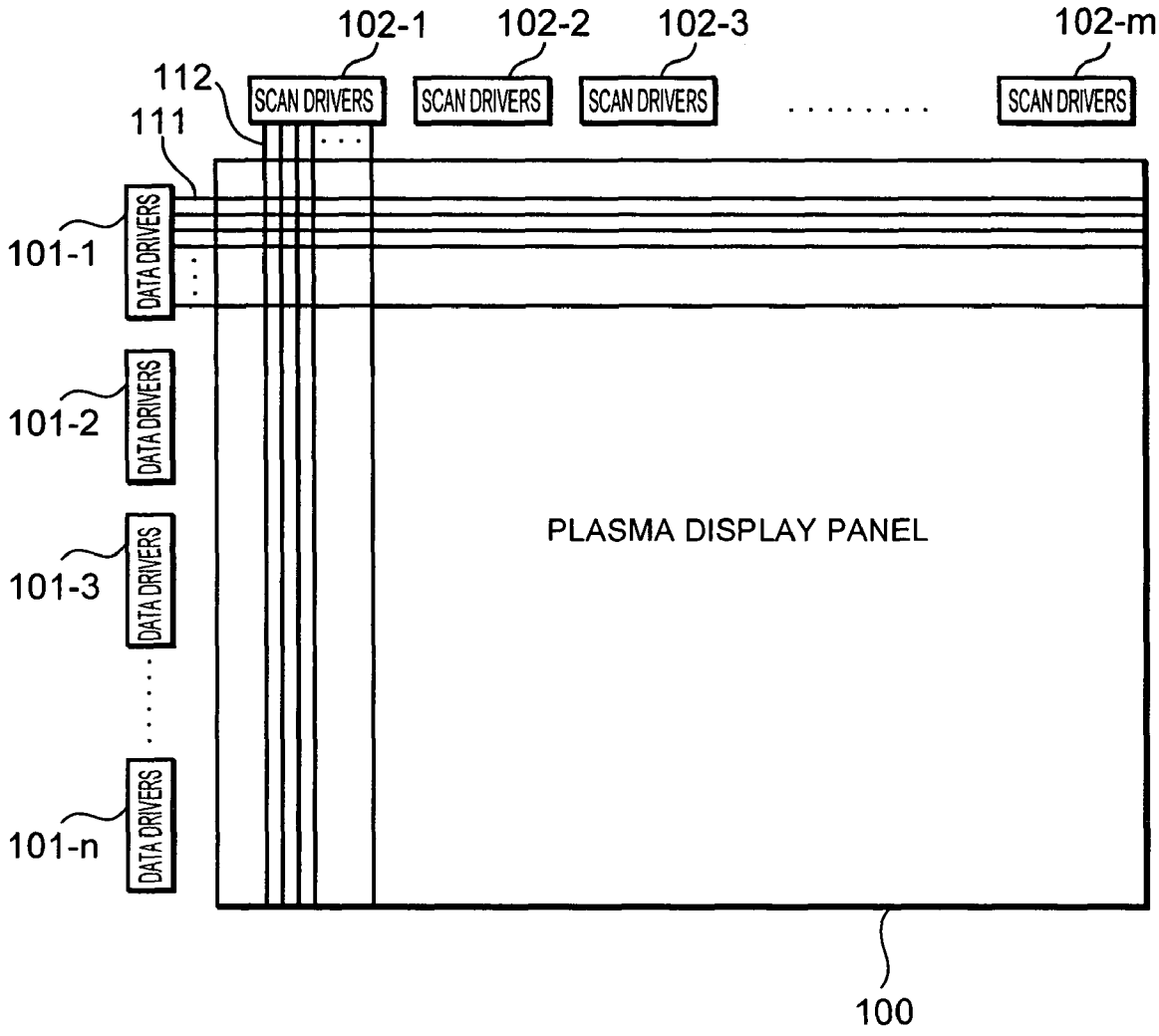
FIG. 9 is a drawing showing schematically an example of the constitution of a PDP driving apparatus for driving a PDP.
Figure 10:
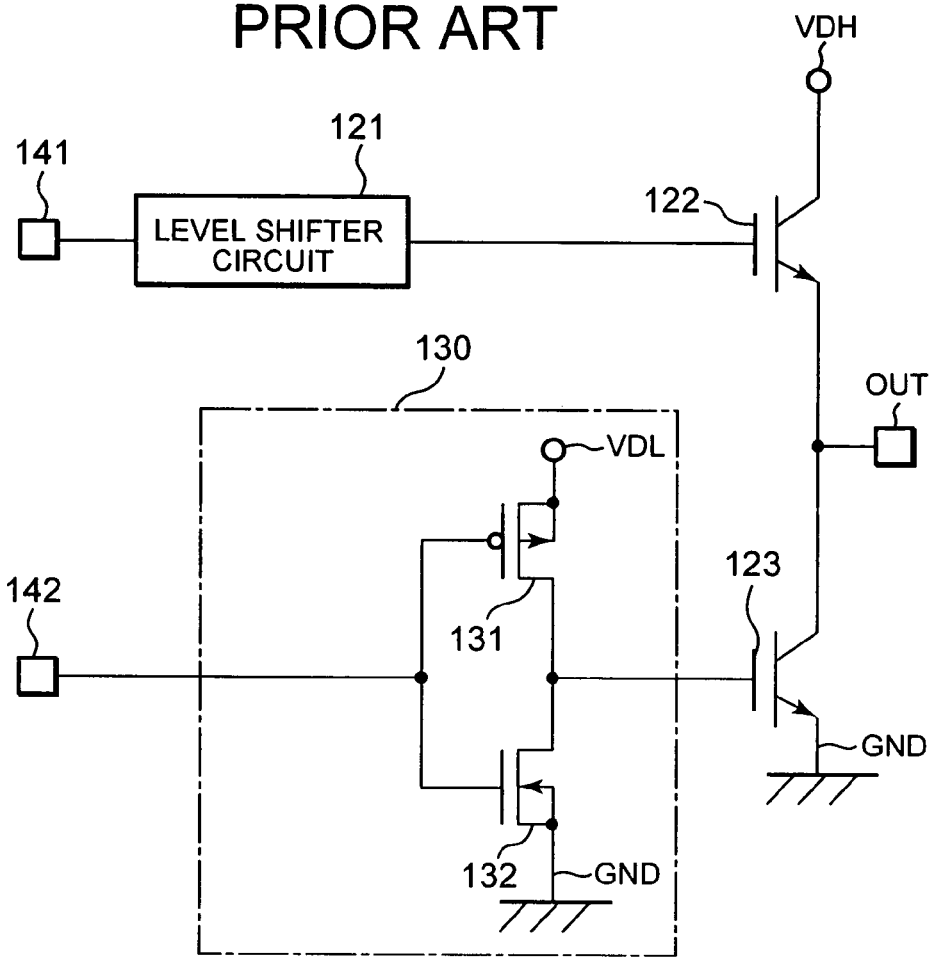
FIG. 10 PRIOR ART
FIG. 10 is a circuit diagram of the output stage in conventional PDP display apparatus driving circuitry.
Figure 11:
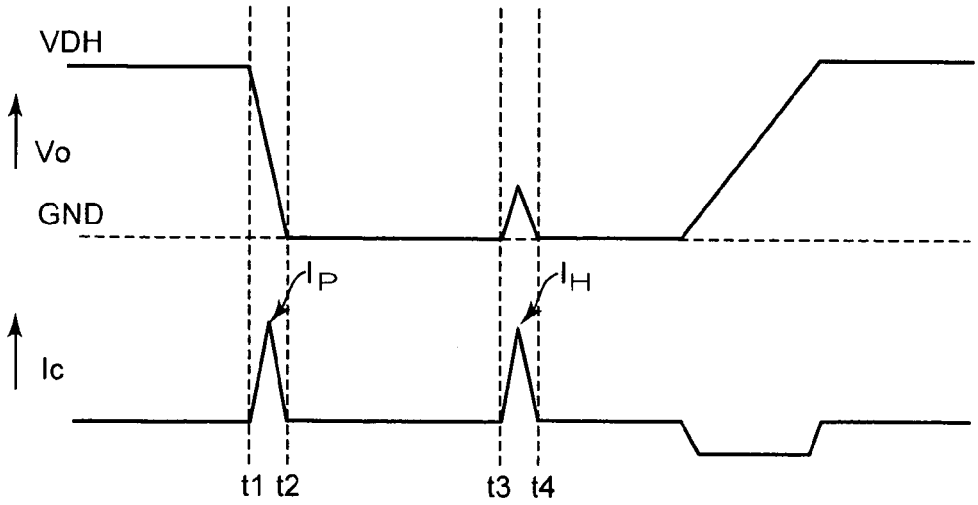
FIG. 11 PRIOR ART
FIG. 11 is a timing diagram showing part of the voltage and current waveforms during an address electrical discharge for the output stage circuitry of the conventional display apparatus driving circuitry for driving a PDP.

The output terminal OUT is, for example, connected to a scanning/sustaining electrode 111 as shown in FIG. 9, and is further connected to an electrical discharge cell (which can be regarded as a capacitor C).

With this circuitry, when a signal of 0 to 5 volts is inputted to the input terminal 31, and the input terminal 31 becomes 'H', this signal is converted into a signal of 0 to 100 volts by the level shifter circuit 11. As a result, the gate of the IGBT 12 is made to be 'H', the IGBT 12 is turned on, and a signal with a high voltage of 100 volts is outputted to the output terminal OUT.

At the time of an address electrical discharge, it is necessary to turn the IGBT 13 on, and thus reduce the potential at the output terminal OUT to 0 volts. To do this, the input terminal 31 is made to be 'L', and the signal of 0 to 5 volts at the input terminal 32 is made to be 'L'. As a result, through the buffer circuit 20, the gate of the IGBT 13 is made to be 'H' and the IGBT 13 is turned on. This causes 0 volts, i.e. the same potential as at GND, to be outputted to the output terminal OUT.

At this time, with the display apparatus driving circuitry of the first embodiment of the invention, unlike conventionally, a voltage lower than the low voltage supplied from the low-voltage power supply terminal VDL (approximately 3 volts) is applied to the gate of the IGBT 13. The reasons for this may be explained as follows with reference to FIG. 2.

Figure 2:
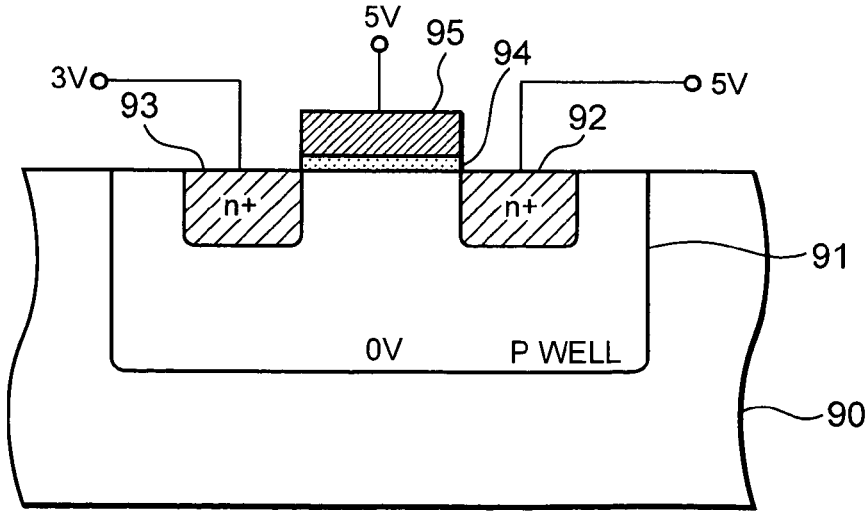
FIG. 2 is a schematic sectional drawing of the constitution of an NMOS connected to a low-voltage power supply terminal VDL in a buffer circuit.

FIG. 2 is a schematic sectional drawing of the constitution of the NMOS 21 connected to the low-voltage power supply terminal VDL in the buffer circuit 20.

As shown in FIG. 2, the NMOS 21 shown in FIG. 1 comprises a p well 91 formed on a substrate 90, a drain 92 and a source 93, which are formed by injection in an n+ type impurity from the surface of the p well 91. The NMOS 21 also includes a gate oxide film 94 formed on the p well 91, and a gate electrode 95 formed on the gate oxide film 94.

With this NMOS 21, when 5 volts is applied to the gate electrode 95, a channel (not shown) is formed, and hence the NMOS 21 goes into an 'on' state. At this time, the p well 91 is at 0 volts. If 5 volts (VDL) is applied to the drain 92 from the low-voltage power supply terminal VDL shown in FIG. 1, then the potential drops on the source 93 side due to a back gate effect (also known as a substrate effect) and becomes approximately 3 volts. Because the source 93 of the NMOS 21 is connected to the gate of the IGBT 13 as shown in FIG. 1, a voltage of approximately 3 volts, which is lower than VDL, is supplied to the gate of the IGBT 13.

Figure 3:
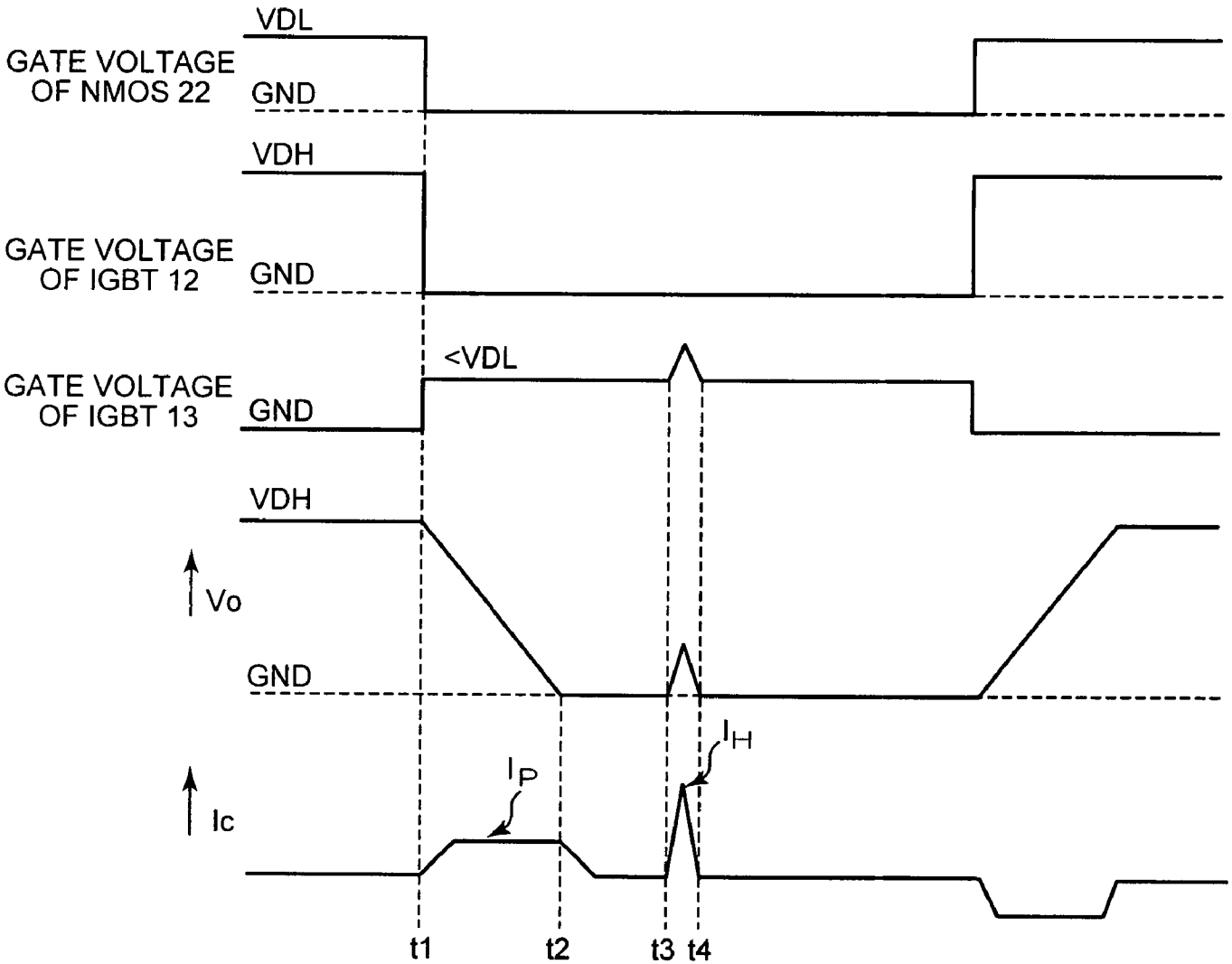
FIG. 3 is a timing diagram showing part of the voltage and current waveforms during an address electrical discharge for the output stage circuitry of the display apparatus driving circuitry for a PDP according to the first embodiment of the invention.

FIG. 3 is a timing diagram showing part of the voltage and current waveforms during an address electrical discharge for the output stage circuitry of the display apparatus driving circuitry for a PDP according to the first embodiment of the invention. Here, regarding the elements shown in FIG. 1, the waveforms for the gate voltage of the NMOS 22, the gate voltages of the IGBTs 12 and 13, the potential Vo at the output terminal OUT, and the current Ic flowing into the collector of the IGBT 13 are shown.

At the time of an address electrical discharge, the input terminals 31 and 32 are both made to be 'L', whereupon the gate voltage of the IGBT 12 drops from VDH to GND. The gate voltage of the NMOS 22 of the buffer circuit 20 also drops to GND, and the gate voltage of the IGBT 13 rises to a voltage of approximately 3 volts, which is lower than VDL, and thus the IGBT 13 goes into an 'on' state (time t1). When the IGBT 13 is turned on in this way, compared with the case that the IGBT 13 is turned on by VDL (5 volts), the drop in the waveform of the potential Vo is more gradual; the potential Vo becomes 0 volts at time t2. At this time, the current $I_P$ due to charge stored in the electrical discharge cell connected to the output terminal OUT does not flow rapidly as conventionally. Rather, the current $I_P$ is suppressed and flows into the GND connected to the emitter of the IGBT 13 in accordance with the time period up to the time t2 at which the potential Vo becomes 0. After the potential Vo has become 0, once the effective voltage due to a high voltage applied to the data electrode 112 (see FIG. 9) has become sufficiently high (time t3), a plasma discharge is started, and hence a discharge current $I_H$ flows. The discharge current $I_H$ stops flowing at a time t4. Regarding the discharge current $I_H$ in this case, a large current flows rapidly as conventionally.

The reason that the discharge current $I_H$ is not suppressed now will be explained. During the address electrical discharge, the discharge current $I_H$ flows into the collector of the IGBT 13 rapidly. Thus, due to the drain-gate capacitance, i.e. the parasitic capacitance, of the IGBT 13, the gate voltage of the IGBT 13 rises, and the potential Vo is raised accordingly, as shown in FIG. 3. The gate of the IGBT 13 thus rises to approximately 5 volts (VDL), causing a large current to flows instantaneously. This makes possible a stable display.

In this way, without suppressing the discharge current $I_H$, the drop in the output waveform during the address electrical discharge can be made gradual, whereby noise can be prevented. Moreover, the current supply capacity is suppressed, and so that breakage of the device due to an excessive current upon a short-circuiting of the output can be prevented.

Figure 4:
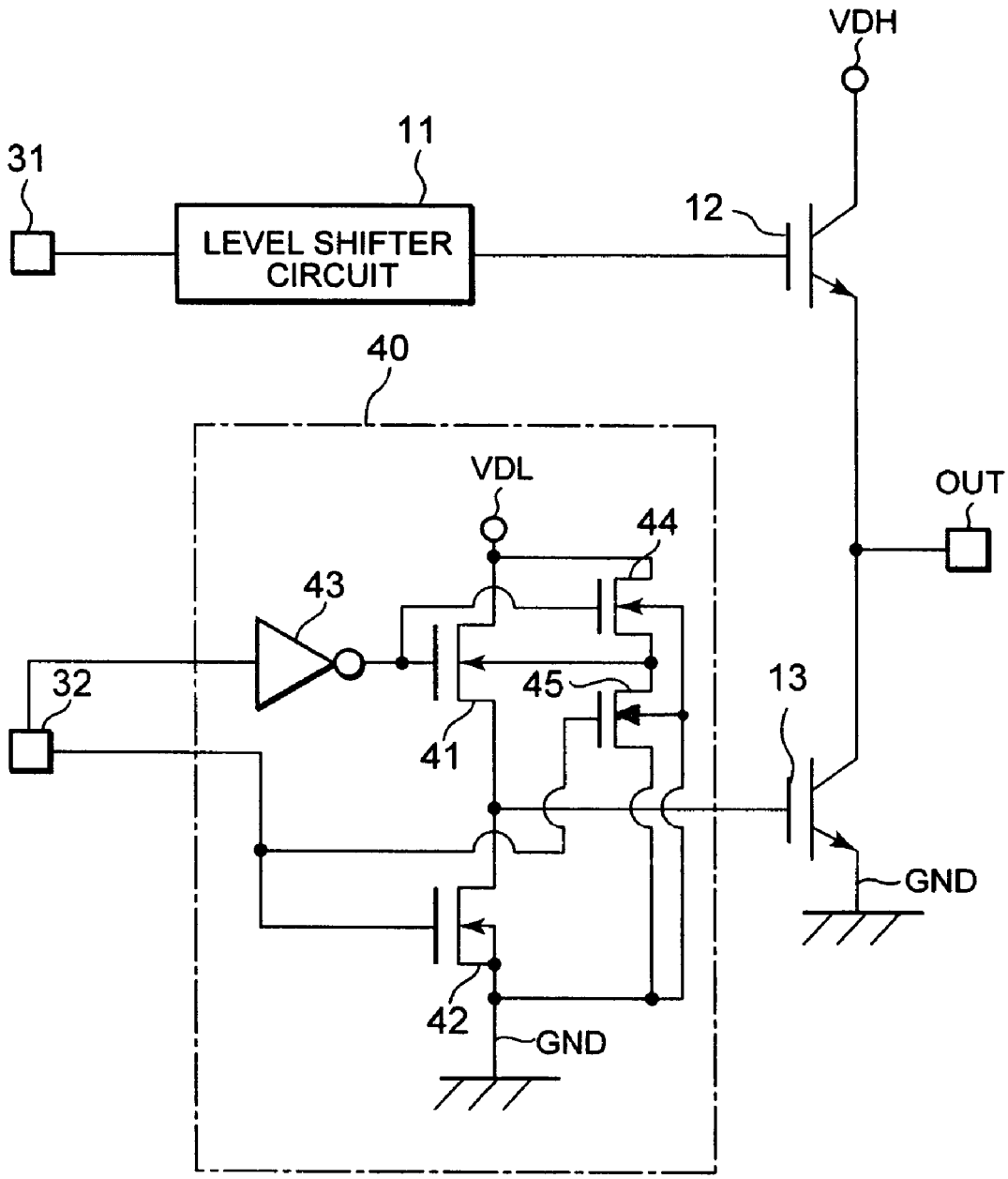
FIG. 4 is a circuit diagram of display apparatus driving circuitry of a second embodiment of the invention.

Next, a description will be given of display apparatus driving circuitry of a second embodiment of the invention. FIG. 4 is a circuit diagram of the display apparatus driving circuitry of the second embodiment.

With the display apparatus driving circuitry of the second embodiment shown here, only the buffer circuit differs from that in the first embodiment. Therefore for other constituent elements, the same reference numeral as in the first embodiment will be used, and their description will be omitted.

As in the first embodiment, the buffer circuit 40 in the display apparatus driving circuitry of the second embodiment has NMOSs 41 and 42, and an inverter circuit 43 (these correspond respectively to the NMOSs 21 and 22 and the inverter circuit 23 in FIG. 1). The input terminal 32 is connected to the gate of the NMOS 42, and is connected to the gate of the NMOS 41 via the inverter circuit 43. Moreover, the NMOS 41 is electrically connected between the gate of the IGBT 13 and a low-voltage power supply terminal VDL from which a low voltage of 0 to 5 volts for logic is supplied. Moreover, the source of the NMOS 41 is further connected to the drain of the NMOS 42. The NMOS 42 is electrically connected (grounded) between the gate of the IGBT 13 and GND. The buffer circuit 40 of the second embodiment further has an NMOS 44 that is electrically connected between the substrate of the NMOS 41 (which corresponds to the p well 91 in FIG. 2) and the low-voltage power supply terminal VDL, and an NMOS 45 that is electrically connected between the substrate of the NMOS 41 and GND.

When the input terminal 32 is 'H', this value is inverted by the inverter circuit 43, so that the gate of the NMOS 41 becomes 'L', and thus the NMOS 41 is turned off. Moreover, at this time, the NMOS 45 is turned on, and thus the potential at the substrate of the NMOS 41 becomes 0 volts. As a result, the output of the buffer circuit 40 becomes 0 volts through the NMOS 42 being turned on. Therefore, 0 volts is outputted to the gate of the IGBT 13.

At the time of an address electrical discharge, the input terminal 32 is made to be 'L', and this value is inverted by the inverter circuit 43. Thus, the gate of the NMOS 41 becomes 'H', and the NMOS 41 is turned on. At this time, the NMOS 44 is also turned on, so that the potential at the source of the NMOS 44 becomes approximately 3 volts due to a back gate effect, and as a result the potential at the substrate of the NMOS 41 rises to approximately 3 volts. The output of the NMOS 41 is thus raised, and hence a potential of approximately 4 volts is outputted, and is supplied to the gate of the IGBT 13, whereby the IGBT 13 can be turned on.

In this way, according to the display apparatus driving circuitry of the second embodiment, the voltage inputted to the gate of the IGBT 13 when the output waveform drops during the address electrical discharge can be raised to approximately 4 volts. This is effective in the case that one wishes to get by without this voltage dropping down to 3 volts as in the first embodiment.

Figure 5:
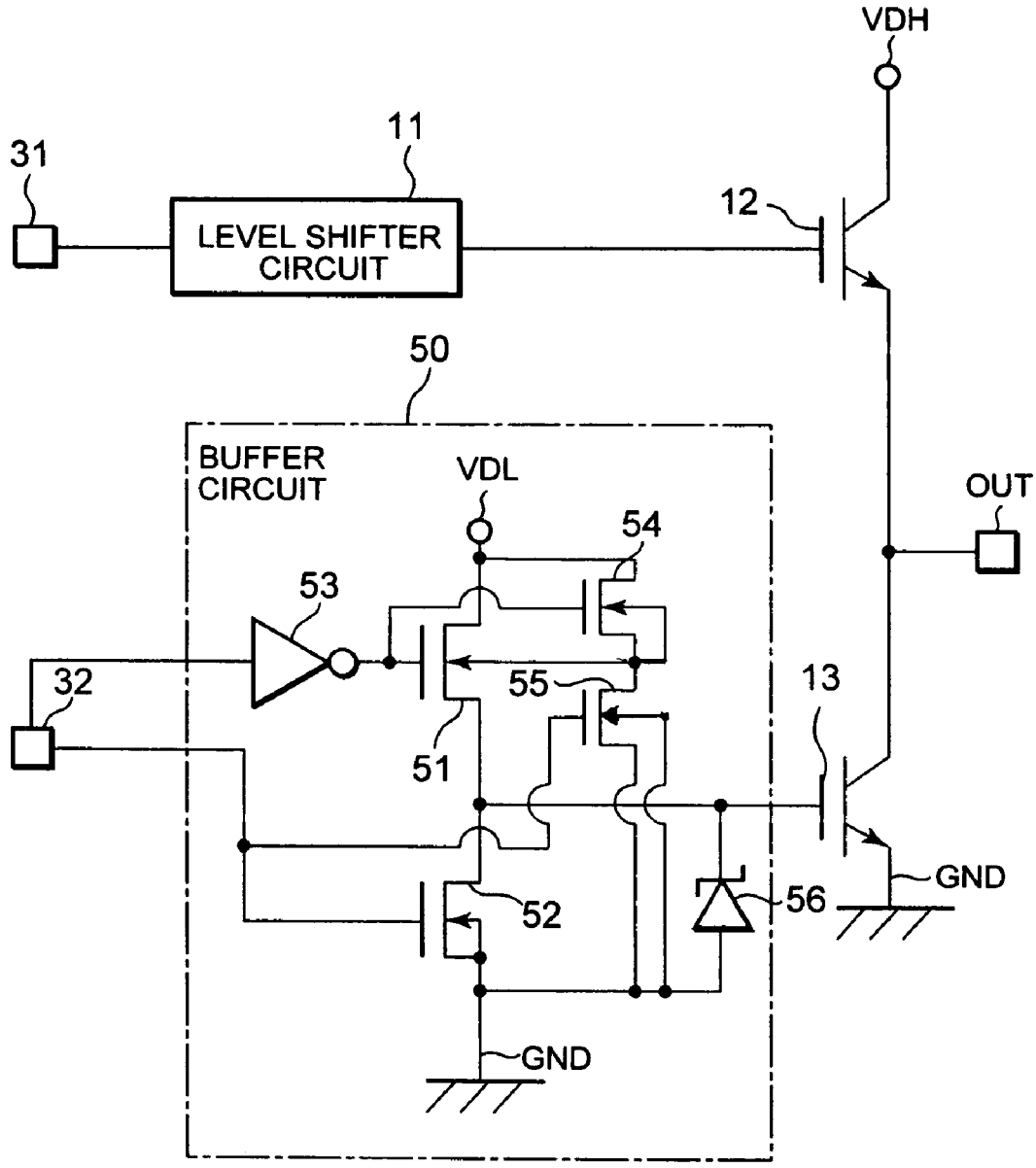
FIG. 5 is a circuit diagram of display apparatus driving circuitry of a third embodiment of the invention.

Next, a description will be given of display apparatus driving circuitry of a third embodiment of the invention. FIG. 5 is a circuit diagram of the display apparatus driving circuitry of the third embodiment.

With the display apparatus driving circuitry of the third embodiment shown here, only the buffer circuit is different than that in the first embodiment. Therefore, for other constituent elements, the same reference numeral as in the first embodiment will be used, and description will be omitted here.

As with the buffer circuit 20 of the first embodiment, the buffer circuit 50 in the display apparatus driving circuitry of the third embodiment has NMOSs 51 and 52, and an inverter circuit 53 (these correspond respectively to the NMOSs 21 and 22 and the inverter circuit 23 in FIG. 1). The input terminal 32 is connected to the gate of the NMOS 52, and is connected to the gate of the NMOS 51 via the inverter circuit 53. Moreover, the NMOS 51 is electrically connected between the gate of the IGBT 13 and a low-voltage power supply terminal VDL from which a low voltage of 0 to 5 volts for logic is supplied. Moreover, the source of the NMOS 51 is further connected to the drain of the NMOS 52. The NMOS 52 is electrically connected (grounded) between the gate of the IGBT 13 and GND. Furthermore, as in the second embodiment, the buffer circuit further has an NMOS 54 and an NMOS 55. The NMOS 54 is electrically connected between the substrate of the NMOS 51 (which corresponds to the p well 91 in FIG. 2) and the low-voltage power supply terminal VDL. The NMOS 55 is electrically connected between the substrate of the NMOS 51 and GND.

However, with the buffer circuit 50 of the third embodiment, unlike with the buffer circuit 40 of the second embodiment, the NMOS 54 has its substrate electrically connected to its own source, and hence the NMOS 54 raises the potential of its own substrate. The gate potential is 5 volts. The substrate potential therefore is raised to approximately 4.4 volts, with the threshold value being at least approximately 0.6 volt. With the buffer circuit 50 of the third embodiment, the substrate potential of the NMOS 51 is raised to the substrate potential of the NMOS 54, the source potential of the NMOS 52 becomes at least approximately 4.4 volts, and a voltage less than 5 volts (VDL) can be inputted to the IGBT 13. In this way, according to the display apparatus driving circuitry of the third embodiment, the voltage inputted to the gate of the IGBT 13 when the output waveform drops during the address electrical discharge can be raised to approximately 4.4 volts.

Note that in FIG. 5, a Zener diode 56 is connected between the gate of the IGBT 13 and GND, whereby the gate of the IGBT 13 is protected from being subjected to a voltage above 5 volts. Such a Zener diode 56 may also be used in the display apparatus driving circuitry of the first and second embodiments shown in FIGS. 1 and 4. Moreover, such a Zener diode may also be connected between the emitter and the gate of the IGBT 12 to protect the gate of the IGBT 12.

In this way, with the second and third embodiments of the invention, the voltage applied to the gate of the IGBT 13 can be raised more than in the first embodiment. This is useful when it is not necessary to lower this voltage down approximately 3 volts.

As described above, with the display apparatus driving circuitry according to the first to third embodiments of the invention, when the IGBT 13 is on its the gate potential is reduced below VDL by using a back gate effect. However, a second low-voltage power supply terminal VDL2 that supplies a voltage lower than VDL may instead be provided, whereby the gate potential, when on, can be reduced with a prescribed timing. This case will now be described as a fourth embodiment of the invention.

Figure 6:
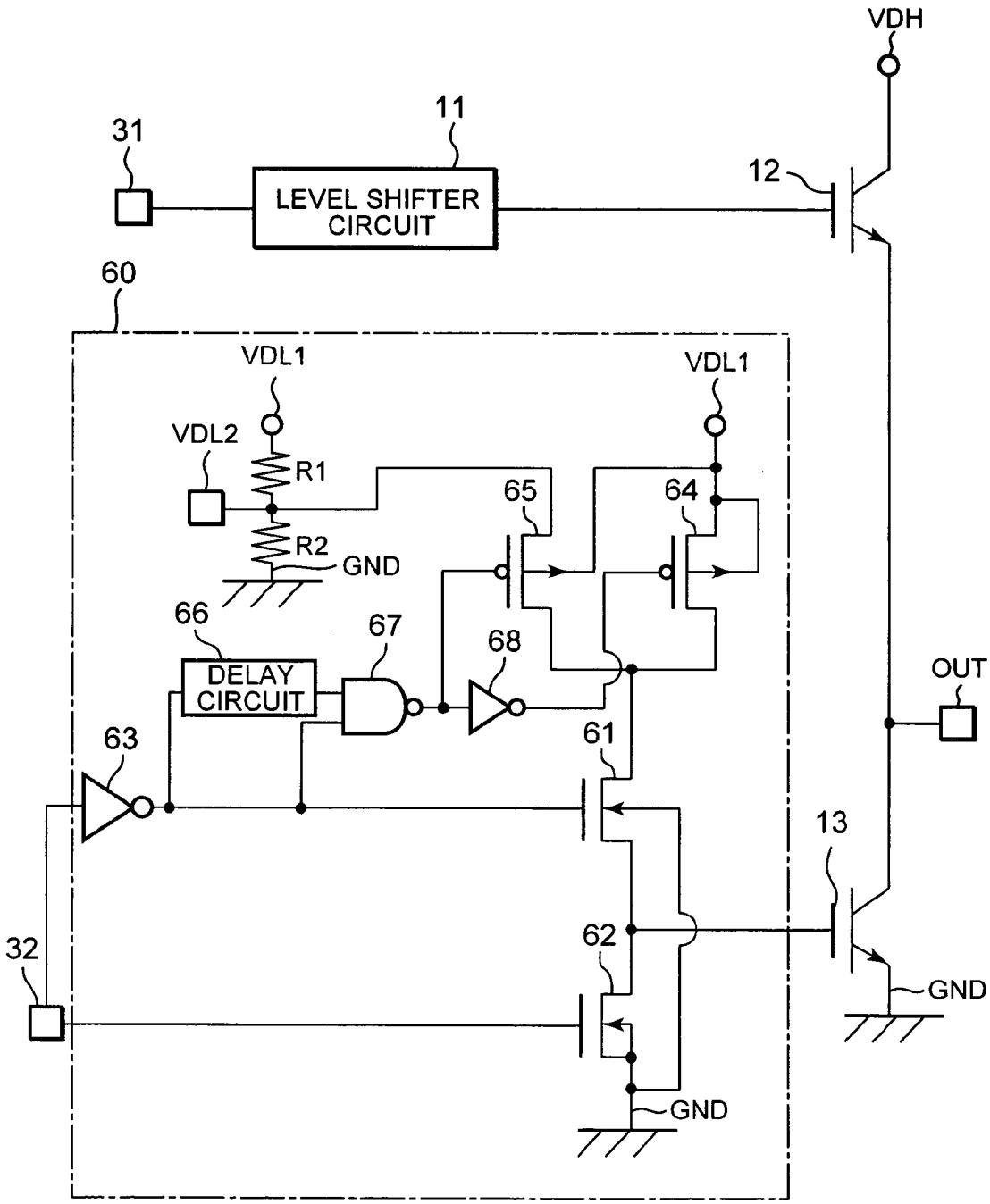
FIG. 6 is a circuit diagram of display apparatus driving circuitry of a fourth embodiment of the invention.

FIG. 6 is a circuit diagram of the display apparatus driving circuitry of the fourth embodiment of the invention. With the display apparatus driving circuitry of the fourth embodiment shown here, only the buffer circuit is differs from the first embodiment. Therefore, for other constituent elements, the same reference numerals as in the first embodiment will be used, and description here will be omitted.

Unlike in the first to third embodiments, with the buffer circuit 60 of the fourth embodiment, power is supplied from two low-voltage power supply terminals VDL1 and VDL2. Note that in the following, the low voltage for logic supplied from the low-voltage power supply terminal VDL1 will be referred to as 'VDL,' as for the low voltage in the first to third embodiments, and the voltage supplied from the low-voltage power supply terminal VDL2 will be referred to as 'VDL2'. VDL2 is, for example, 0.5×VDL.

Moreover, with the buffer circuit 60 of FIG. 6, a case is shown in which the voltage supplied from the low-voltage power supply terminal VDL2 is generated by dividing VDL and a reference voltage using resistors R1 and R2. Note, however, that VDL2 may instead be supplied from the outside.

As with the buffer circuit 20 of the first embodiment, the buffer circuit 60 in the display apparatus driving circuitry of the fourth embodiment has NMOSs 61 and 62, and an inverter circuit 63 (these correspond respectively to the NMOSs 21 and 22 and the inverter circuit 23 in FIG. 1). The buffer circuit 60 further has a PMOS 64 electrically connected to the low-voltage power supply terminal VDL1, and a PMOS 65 electrically connected to the low-voltage power supply terminal VDL2.

The NMOS 61 is electrically connected between the drains of the PMOSs 64 and 65 and the gate of the IGBT 13. Moreover, the source of the NMOS 61 is further connected to the drain of the NMOS 62. The NMOS 62 is electrically connected between the gate of the IGBT 13 and GND.

The input terminal 32 is connected to the gate of the NMOS 62, and is connected to the gate of the NMOS 61 via the inverter circuit 63. The input terminal 32 also is connected to an input terminal of a NAND circuit 67 via the inverter circuit 63 and a delay circuit 66, and to the other input terminal of the NAND circuit 67 via only the inverter circuit 63. The output terminal of the NAND circuit 67 is connected to the gate of the PMOS 65, and to the gate of the PMOS 64 via an inverter circuit 68.

Figure 7:
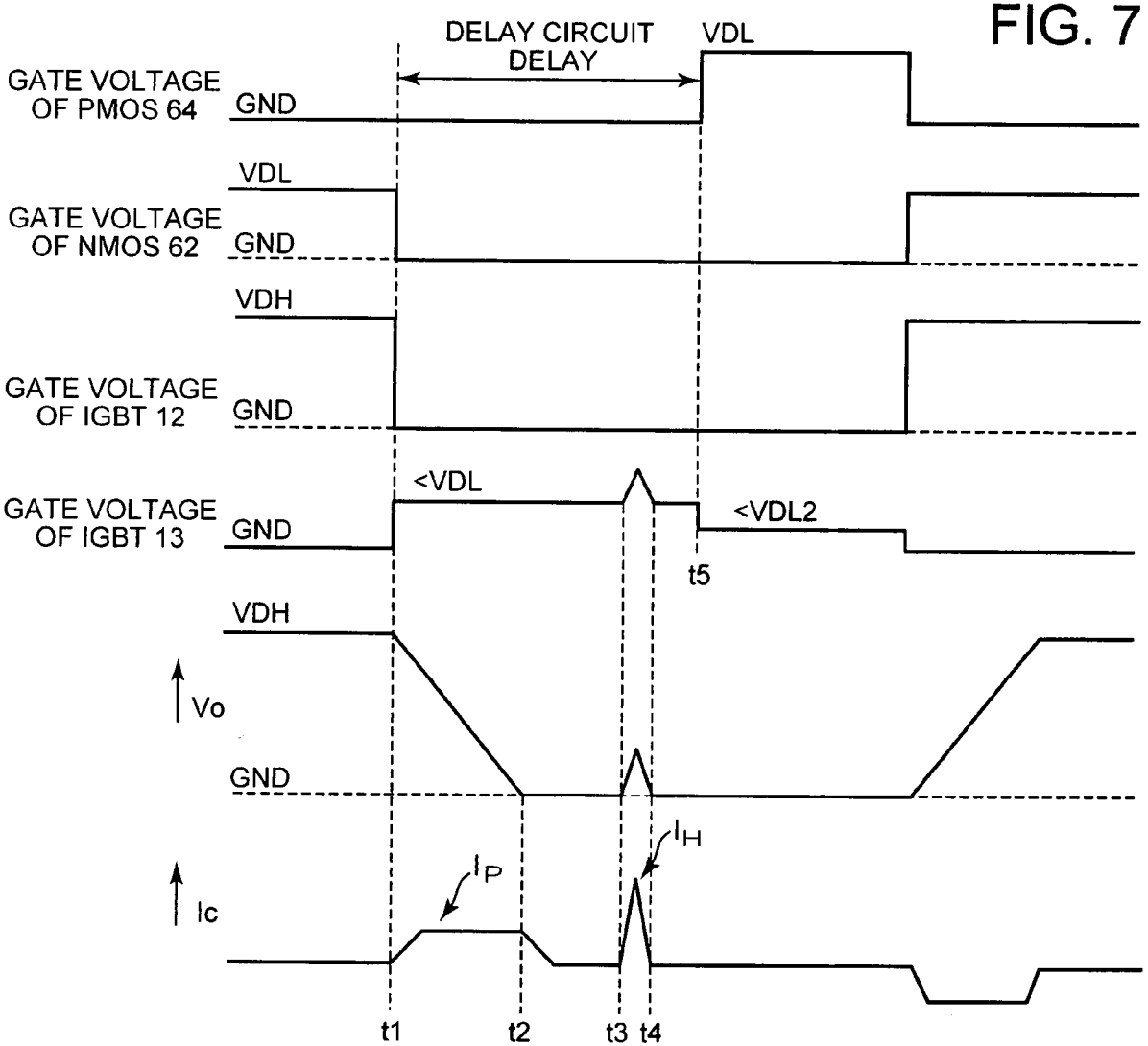
FIG. 7 is a timing diagram showing part of the voltage and current waveforms during an address electrical discharge for the output stage circuitry of the display apparatus driving circuitry according to the fourth embodiment of the invention.

Following is a description of the operation of the display apparatus driving circuitry of the fourth embodiment at the time of an address electrical discharge, with reference to FIG. 7. FIG. 7 is a timing diagram showing part of the voltage and current waveforms during an address electrical discharge for the output stage circuitry of the display apparatus driving circuitry according to the fourth embodiment. Here, the waveforms for the gate voltage of the PMOS 64, the gate voltage of the NMOS 62, the gate voltages of the IGBTs 12 and 13, the potential Vo at the output terminal OUT, and the current Ic flowing into the collector of the IGBT 13 are shown.

At the time of an address electrical discharge, the input terminals 31 and 32 are both made to be 'L', whereupon the gate voltage of the IGBT 12 drops from VDH to GND, the gate voltage of the NMOS 62 of the buffer circuit 60 also drops to GND. Thus the NMOS 62 is turned off, and the NMOS 61 is turned on. At this time, for the NAND circuit 67, one of the terminals is 'L' due to a delay of, for example, approximately 100 nsec caused by the delay circuit 66. The other input terminal is 'H', and hence the output is 'H'. As a result, the gate voltage of the PMOS 64 stays at GND as shown in FIG. 7, i.e. the 'on' state is maintained. Therefore, VDL is supplied to the drain of the NMOS 61. The gate voltage of the IGBT 13 thus rises to a voltage of approximately 3 volts, which is lower than VDL, due to a back gate effect. As a result, IGBT 13 goes into an 'on' state (time t1).

When the IGBT 13 is turned on in this way, as described in the first to third embodiments, compared with the case that the IGBT 13 is turned on by VDL (5 volts), the drop in the waveform of the potential Vo is more gradual; the potential Vo becomes 0 volts at time t2. At this time, the current $I_P$ due to charge stored in the electrical discharge cell connected to the output terminal OUT flows through the emitter of the IGBT 13 to the GND in accordance with the time period up to the time t2 at which the potential Vo becomes 0.

After the potential Vo has become 0, once the effective voltage due to a high voltage applied to the data electrode 112 (see FIG. 9) has become sufficiently high (time t3), a plasma discharge is started, and hence a discharge current $I_H$ flows. The discharge current $I_H$ stops flowing at a time t4.

At a time t5 when the delay due to the delay circuit 66 comes to an end, the output of the NAND circuit 67 becomes 'L'. At this time, the gate voltage of the PMOS 64 rises to VDL. Hence the PMOS 64 is turned off, and VDL2, which is lower than VDL, is inputted to the source of the PMOS 65, causing the PMOS 65 to turn on. As a result, the voltage VDL2, which is lower than VDL, is supplied to the drain of the NMOS 61, and therefore the gate voltage of the IGBT 13 drops to a voltage less than VDL2, becoming less than 3 volts, for example 2.5 volts.

In this way, by having the two PMOSs 64 and 65 which are connected to two different low-voltage power supply terminals VDL1 and VDL2, the gate voltage supplied to the IGBT 13 can be changed. Moreover, due to the delay circuit 66, during the fall of the potential Vo when a current must be passed and the period when the discharge current $I_H$ flows, the gate voltage is made to be highish (but less than VDL), and then subsequently the gate voltage is adjusted to be lower; as a result, even if the output terminal OUT were short-circuited to VDH (100 volts), because the current supply capacity of IGBT 13 is suppressed, latch-up would not occur and hence breakage of the device can be prevented.

Figure 8:
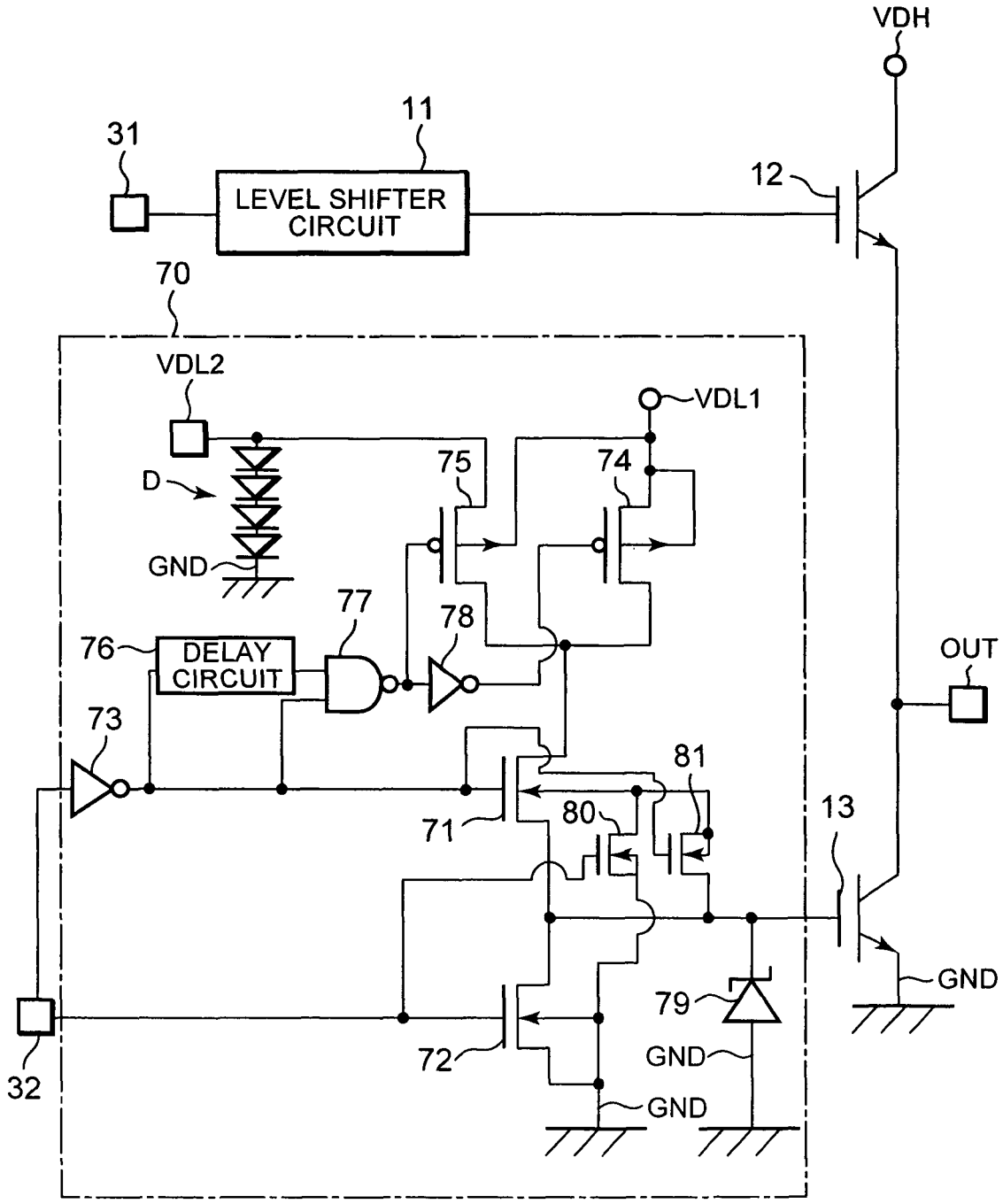
FIG. 8 is a circuit diagram of display apparatus driving circuitry of a fifth embodiment of the invention.

Next, an application of the display apparatus driving circuitry of the fourth embodiment will be described as a fifth embodiment. FIG. 8 is a circuit diagram of the display apparatus driving circuitry of the fifth embodiment. With the display apparatus driving circuitry of the fifth embodiment shown here, only the buffer circuit is different to in the first to fourth embodiments. Therefore, for other constituent elements, the same reference numeral as before will be used, and description will be omitted here.

As in the fourth embodiment, the buffer circuit 70 of the fifth embodiment has an NMOS 71, an NMOS 72, an inverter circuit 73, a PMOS 74, a PMOS 75, a delay circuit 76, a NAND circuit 77, and an inverter circuit 78. With the buffer circuit 70 of the fifth embodiment, a Zener diode 79 is connected between the gate of the IGBT 13 and GND, thus protecting the gate of the IGBT 13 from being subjected to a voltage above 5 volts.

Furthermore, the buffer circuit 70 has NMOSs 80 and 81 for allowing the substrate potential of the NMOS 71 to vary. The NMOS 80 is electrically connected between the substrate of the NMOS 71 and GND, and the gate of the NMOS 80 is connected to the input terminal 32. On the other hand, the NMOS 81 is electrically connected between the substrate of the NMOS 71 and the gate of the IGBT 13, and the gate of the NMOS 81 is connected to the input terminal 32 via the inverter circuit 73.

By disposing the NMOSs 80 and 81 in this way, the substrate potential of the NMOS 71 becomes at the GND level when the NMOS 71 is off due to the NMOS 80 being turned on, and becomes at the level of the potential applied to the gate of the IGBT 13 when the NMOS 71 is on due to the NMOS 81 being turned on. As a result, the on resistance of the NMOS 71 can be increased, and hence the on operation of the IGBT 13 can be made rapid.

Moreover, the buffer circuit 70 shown in FIG. 7 includes a plurality of (e.g. four) diodes D connected to each other in series and connected to GND, whereby a voltage lower than VDL, e.g. approximately 2.4 volts can be produced as the voltage supplied by the low-voltage power supply terminal VDL2. Note, however, that VDL2 may instead be supplied from the outside.

Alternatively, it may be made such that VDL2 is directly connected to GND.

Note that in the above description of the first to fifth embodiments, the output stage switch was formed as a totem pole switch, but this switch may instead be made to be a push-pull switch.

Moreover, IGBTs 12 and 13 were used for the output stage switch, but devices having an insulated gate such as MOSFETs may be used instead. Moreover, numerical values such as voltages in the above description are merely examples, and there is no limitation to these values.

The invention can be applied to a driving apparatus for a plasma display panel used in a display device of an information terminal or a personal computer, or a television image display apparatus, or the like. The application incorporates by reference the entire disclosures of Japanese patent publication numbers JP PA 2003-292234, filed Jul. 30, 2003 and Japanese patent specification no. JP PA 2003-39-0062, filed Nov. 20, 2003.

What is claimed is:

1. Display apparatus driving circuitry, comprising:

an output terminal;

a high-voltage power supply terminal for supplying a high voltage;

a first low-voltage power supply terminal for supplying a first low voltage for logic;

a second low-voltage power supply terminal for supplying a second low voltage;

a reference power supply terminal;

a first transistor electrically connected between the output terminal and the high-voltage power supply terminal;

a second transistor connected between the output terminal and the reference power supply terminal; and a buffer circuit comprising a first p-channel type MOS field effect transistor (PMOS) electrically connected to the first low-voltage power supply terminal, a second p-channel type MOS field effect transistor (PMOS) electrically connected to the second low-voltage power supply terminal, a first NMOS electrically connected between (a) a drain of the first PMOS and a drain of the second PMOS and (b) a gate of the second transistor, and a second NMOS electrically connected between the gate of the second transistor and the reference power supply terminal.

2. The display apparatus driving circuitry according to claim 1, wherein the buffer circuit varies the gate voltage of the second transistor by turning one of the first PMOS and the second PMOS on and turning the other one of the first PMOS and the second PMOS off.

3. The display apparatus driving circuitry according to claim 2, wherein the buffer circuit includes a delay circuit that controls a time period for the turning on and off of the first PMOS and the second PMOS.

4. The display apparatus driving circuitry according to claim 1, further comprising a Zener diode between the gate of the second transistor and the reference power supply terminal, for protecting the gate of the second transistor.

5. The display apparatus driving circuitry according to claim 1, the second low voltage is produced from the first low voltage.

6. The display apparatus driving circuitry according to claim 1, wherein the first transistor and the second transistor are insulated gate bipolar transistors.

* * * * *